US011384455B2

(12) United States Patent
Jakobinski et al.

(10) Patent No.: US 11,384,455 B2
(45) Date of Patent: Jul. 12, 2022

(54) FIBRE BAND OPENING DEVICE FOR AN OPEN-END SPINNING DEVICE AND FEED TRAY FOR THE FIBRE BAND OPENING DEVICE

(71) Applicant: Saurer Spinning Solutions GmbH & Co. KG, Übach-Palenberg (DE)

(72) Inventors: Andreas Jakobinski, Erkelenz (DE); Lothar Winzen, Herzogenrath (DE); Florian Keuter, Baesweiler (DE); Jens Geerligs, Korschenbroich (DE)

(73) Assignee: Saurer Spinning Solutions GmbH & Co. KG, Übach-Palenberg (DE)

( * ) Notice: Subject to any disclaimer, the term of this patent is extended or adjusted under 35 U.S.C. 154(b) by 0 days.

(21) Appl. No.: 16/905,150

(22) Filed: Jun. 18, 2020

(65) Prior Publication Data

US 2020/0399791 A1 Dec. 24, 2020

(30) Foreign Application Priority Data

Jun. 19, 2019 (DE) ..... 102019116584.9

(51) Int. Cl.
*D01H 4/32* (2006.01)

(52) U.S. Cl.
CPC ..... *D01H 4/32* (2013.01)

(58) Field of Classification Search
CPC .. D01H 4/30; D01H 4/32; D01H 4/34; D01H 4/36
See application file for complete search history.

(56) References Cited

U.S. PATENT DOCUMENTS 4,024,699 A * 5/1977 Goldammer ..... D01H 4/32 57/412
4,507,827 A * 4/1985 Staehli ..... D01H 4/36 19/200

(Continued)

FOREIGN PATENT DOCUMENTS

DE 3501842 A1 7/1986
DE 10351365 A1 6/2005

(Continued)

OTHER PUBLICATIONS

European Search Report, European Application No. 20180129.7-1016, dated Nov. 13, 2020, 6 pages.

*Primary Examiner* — Shaun R Hurley
*Assistant Examiner* — Patrick J. Lynch
(74) *Attorney, Agent, or Firm* — Nelson Mullins Riley & Scarborough LLP

(57) ABSTRACT

Fibre band opening device for an open-end spinning device having a feed tray, a fibre band pull-in cylinder, and an opening roller having an opening roller clothing, the tips of which lie on a circular cylindrical surface, a support surface for fixing a fibre tuft, which is processed by the opening roller by combining, the distance of which support surface from the circular cylindrical surface is tapered in the fibre transport direction to a minimum distance, and a transition area having a convex curvature between the clamping surface and the support surface. The support surface has a distance of between 4 and 8 millimetres from the circular cylindrical surface at the beginning of the support surface with respect to the fibre transport direction, and the minimum distance of the support surface from the circular cylindrical surface is less than 1.5 millimetres.

8 Claims, 3 Drawing Sheets

(56) References Cited

U.S. PATENT DOCUMENTS

| | | | | | |
|---|---|---|---|---|---|
| 5,185,994 | A * | 2/1993 | Stahlecker | D01H 4/30 | 19/105 |
| 5,361,574 | A * | 11/1994 | Gebhardt | D01H 4/32 | 57/408 |
| 5,613,278 | A * | 3/1997 | Temburg | D01G 9/16 | 19/105 |
| 2007/0137168 | A1 * | 6/2007 | Wassenhoven | D01H 4/32 | 57/412 |

FOREIGN PATENT DOCUMENTS

| | | | |
|---|---|---|---|
| DE | 10 2017 118 392 | A1 | 2/2019 |
| GB | 1 402 811 | A | 8/1975 |
| GB | 1 449 922 | A | 9/1976 |

* cited by examiner

FIBRE BAND OPENING DEVICE FOR AN OPEN-END SPINNING DEVICE AND FEED TRAY FOR THE FIBRE BAND OPENING DEVICE

CROSS-REFERENCE TO RELATED APPLICATION

This application claims priority from German National Patent Application No. DE 10 2019 116 584.9, filed Jun. 19, 2019, entitled "Faserbandauflöseeinrichtung für eine Offenend-Spinnvorrichtung and Speisemulde für die Faserbandauflöseeinrichtung", the entire contents of which are incorporated herein by reference.

FIELD OF THE INVENTION

The present invention relates to a fibre band opening device for an open-end spinning device, comprising a feed tray, a fibre band pull-in cylinder, and an opening roller. The fibre band pull-in cylinder is designed to transport, in conjunction with a clamping surface of the feed tray, a feed fibre band towards the opening roller. The feed tray has a support surface for fixing a fibre tuft, which is processed by the opening roller by combing. The feed tray also has a transition area having a convex curvature between the clamping surface and the support surface. The invention also relates to the feed tray having the clamping surface, the support surface for fixing the fibre tuft and the convex transition area between the clamping surface and the support surface.

BACKGROUND OF THE INVENTION

Fibre band opening devices for open-end spinning devices are known in different embodiments and are explained in detail in numerous patent documents.

German Patent Publication DE 35 01 842 C2 describes, for example, a fibre band opening device in which a cylindrically, preferably ribbed fibre band pull-in cylinder forms, together with an associated feed tray, a clamping area for the feed fibre band. The slowly rotating fibre band pull-in cylinder feeds the feed fibre band to a downstream opening roller at a constant transport speed. That means the feed fibre band, which is preferably temporarily stored in spinning cans, first runs through a condenser on its way to the opening roller, which condenser not only condenses the feed fibre band but also gives the feed fibre band a certain profile which is favourable for the pulling in. The condensed feed fibre band subsequently enters the clamping area formed by the fibre band pull-in cylinder and the feed tray, which clamping area is usually wider than the feed fibre band. This ensures that the feed fibre band is also securely clamped in the edge areas. In order to prevent the fibre band from spreading out too far and entering the edge areas of the opening roller, where there is no longer secure combing of the feed fibre band because the sawtooth clothing ends, a fibre tuft support is arranged following the clamping area. However, no further details regarding the geometry of the fibre tuft support are given.

German Patent Publication DE 103 51 365 A1 discloses a feed tray for a fibre band opening device of an open-end spinning device, comprising: a concave clamping area for conveying a feed fibre band, which clamping area acts in conjunction with a fibre band pull-in cylinder; lateral guide walls for guiding the feed fibre band; and a concavely curved support surface for fixing a fibre tuft, which is processed by an opening roller by combing, the feed tray being pivotable about a pivot axis parallel to the axis of rotation of the opening roller. The feed tray is designed in such a way and, in its working position, is arranged in such a way that a gap width of between 0.7 and 1.5 mm results between the support surface and the adjacent tips of the opening roller clothing at a comb-in point, which gap width continuously decreases to a gap width of less than 0.5 millimetres over an angle range of at least 30° in the direction of rotation of the opening roller. It is also explained that, in addition to the continuous decrease of the gap between the support surface and the tips of the opening roller clothing, above all the transition area led as close as possible up to the opening roller is important. A backing-up of the fibre tuft, especially in the production of fancy yarn, should thereby be counteracted.

SUMMARY OF THE INVENTION

The problem addressed by the present invention is that of providing a fibre band opening device that improves the quality of the produced yarn.

In order to solve the stated problem, a fibre band opening device for an open-end spinning device is proposed, which comprises a feed tray, a fibre band pull-in cylinder and an opening roller having an opening roller clothing, the tips of which lie on a circular cylindrical surface. The fibre band pull-in cylinder is designed to transport, in conjunction with a clamping surface of the feed tray, a feed fibre band towards the opening roller. The feed tray has a support surface for fixing a fibre tuft, which is processed by the opening roller by combing. The distance of the support surface from the circular cylindrical surface is tapered in the fibre transport direction to a minimum distance. The feed tray has a transition area having a convex curvature between the clamping surface and the support surface. According to the present invention, the support surface has a distance of between 4 and 8 millimetres from the circular cylindrical surface at the beginning of the support surface with respect to the fibre transport direction, and the minimum distance of the support surface from the circular cylindrical surface is less than 1.5 millimetres.

In particular yarns of synthetic fibres, more particularly of polyester, can be produced with improved yarn values by means of the fibre band opening device according to the present invention. The yarns produced by means of the fibre band opening device according to the present invention have higher yarn strength in particular but also better uniformity than yarns produced by means of fibre band opening devices of prior art.

A sufficient distance of the support surface from the tips of the opening roller clothing, particularly in the run-in area of the fibre tuft support, is important. As a result of a sufficient distance, the fibres are treated gently and damage that negatively affects the yarn quality is avoided. The claimed upper limits for the distance ensure reliable transport of the fibres by the opening roller.

The support surface begins directly after the convex transition area. The beginning of the support surface is the comb-in point for the fibres. The combing-in is a continuous process. The comb-in point is the point at which increased combing-in begins. This point is defined less by the distance from the opening roller and more by the deflection into the circumferential direction of the opening roller. This deflection is largely concluded after the convex transition area has been passed through.

The yarn values can be further improved if the fibres are also given more space in the area of the minimum distance of the support surface from tips of the opening roller clothing than is known in the prior art. According to the prior art, the support surface is generally dimensioned in such a way that the support surface is led as close as possible up to the tips of the opening roller clothing. With respect to the distance, it then merely has to be ensured that contact between the tips and the support surface is reliably prevented. In the case of such feed trays, the minimum distance is generally between 0.2 and 0.5 millimetres.

However, in the present invention, it has proven particularly advantageous to select a minimum distance of the support surface from the circular cylindrical surface that is greater than 0.5 millimetres, preferably greater than 0.6 millimetres.

According to an advantageous embodiment, the tapering of the distance of the support surface from the circular cylindrical surface from the beginning of the support surface to the minimum distance extends over an angle range of less than 30° in the direction of rotation of the opening roller. It is entirely possible for the support surface to continue in the direction of rotation of the opening roller at a constant distance from the circular cylindrical surface after the minimum distance has been reached. It is thus possible, for example, to set the size of a trash outlet opening following the fibre tuft support.

The support surface can be designed as a concave surface from its beginning to its end. However, it is advantageous if the support surface is designed as a flat surface at its beginning, preferably from its beginning until the minimum distance from the circular cylindrical surface is reached, in order to realise the wide run-in area. A concave surface can then follow the flat surface. Depending on the design, the concave surface can have a constant distance from the circular cylindrical surface or continue with a tapering distance.

According to an advantageous embodiment, the flat surface transitions tangentially into the concave surface. An abrupt change in the distance between the support surface and the opening roller is thereby avoided, and this has a positive effect on the yarn quality.

Arranging, if necessary, lateral guide walls for guiding the feed fibre band in the transition area between the clamping surface and the support surface has been disclosed. This is intended to prevent drifting-out of the feed fibre band during the combing. In order to be able to ensure this, the distance between the two lateral guide walls is less than the axial extent of the opening roller. That means the lateral guide walls face the circumferential surface of the opening roller.

According to a preferred embodiment of the fibre band opening device according to the present invention, the feed tray has, in the area of the support surface, lateral guide walls for guiding the feed fibre band, which extend from the beginning to the end of the support surface. This embodiment is sensible, especially in conjunction with an increased minimum distance of the support surface from the circular cylindrical surface of the opening roller clothing. The guide walls can then be led as close as possible up to the tips of the opening roller clothing. Between the guide walls, an increased distance of the support surface from the tips of the opening roller clothing can be realized.

The advantages of the fibre band opening device according to the present invention are achieved mainly by the design of the feed tray. Therefore, the present invention also relates to a feed tray for a fibre band opening device, which comprises a clamping surface, which is designed to transport, in conjunction with a fibre band pull-in cylinder, a feed fibre band towards an opening roller having an opening roller clothing, the tips of which lie on a circular cylindrical surface, a support surface for fixing a fibre tuft, which is processed by the opening roller by combing, the distance of which support surface from the circular cylindrical surface is tapered in the fibre transport direction to a minimum distance, and a transition area having a convex curvature between the clamping surface and the support surface. According to the invention, the support surface has a distance of between 4 and 8 millimetres from the circular cylindrical surface at the beginning of the support surface with respect to the fibre transport direction, and the minimum distance of the support surface from the circular cylindrical surface is less than 1.5 millimetres.

Further areas of applicability of the present invention will become apparent from the detailed description provided hereinafter. It should be understood that the detailed description and specific examples, while indicating the preferred embodiments of the invention, are intended for purposes of illustration only and are not intended to limit the scope of the invention.

BRIEF DESCRIPTION OF THE DRAWINGS

The present invention is explained in greater detail below on the basis of an embodiment example shown in the figures. In the figures.

DESCRIPTION OF THE PREFERRED EMBODIMENTS

The following description of the embodiments of the present invention is merely exemplary in nature and is in no way intended to limit the invention, its application, or uses. The following description is provided herein solely by way of example for purposes of providing an enabling disclosure of the invention, but does not limit the scope or substance of the invention.

Figure 1:
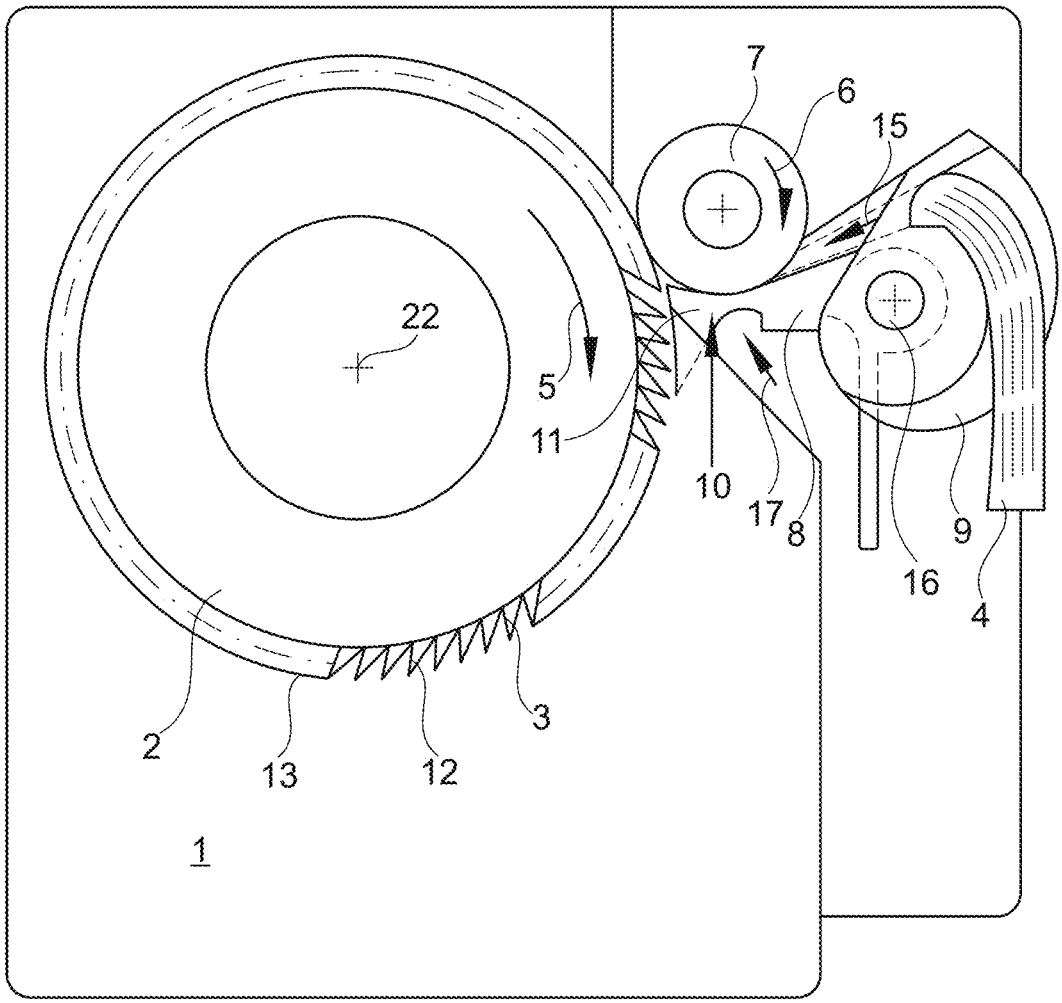
FIG. 1 is a front view of a fibre band opening device according to the present invention.

FIG. 1 shows an opening roller housing 1 of a fibre band opening device for an open-end spinning device. In this opening roller housing 1, an opening roller 2 is mounted for rotation about an axis of rotation 22. The opening roller 2 has, on its outer circumference, what is known as an opening roller clothing 3 for combing a feed fibre band 4. The opening roller clothing 3 comprises teeth, the tips of which lie on a circular cylindrical surface 13, which delimits the opening roller 2. The opening roller 2 runs in the direction of the arrow 5 during the spinning operation.

A fibre band pull-in cylinder 7 rotatable in the direction of the arrow 6 is also mounted in or on the opening roller housing 1. This fibre band pull-in cylinder 7 corresponds with a clamping surface 10 of a feed tray 11, which is pivotably mounted by means of a feed tray holder 8. As indicated in FIG. 1, the feed fibre band 4, which is usually stored in a spinning can (not shown), is conducted in the direction of the arrow 15, via a condenser 9, into a clamping zone, which is formed by the feed tray 11 and the fibre band pull-in cylinder 7. The feed tray holder 8 with the feed tray 11 is mounted for limited movement about a pivot axis 16 and is acted upon by a spring element (not shown) in the direction of the arrow 17 against this direction of movement. The feed tray 11 presses the feed fibre band 4 onto the fibre band pull-in cylinder 7, which rotates in the direction of the arrow 6. The fibre band pull-in cylinder 7 conveys the feed fibre band 4 into the area of the opening roller 2, the opening roller clothing 3 of which combs the feed fibre band 4 into individual fibres, which subsequently, as is known, pass a trash outlet opening 24 and are fed via a fibre guide channel 25 onto a spinning rotor (see FIG. 2).

Figure 3:
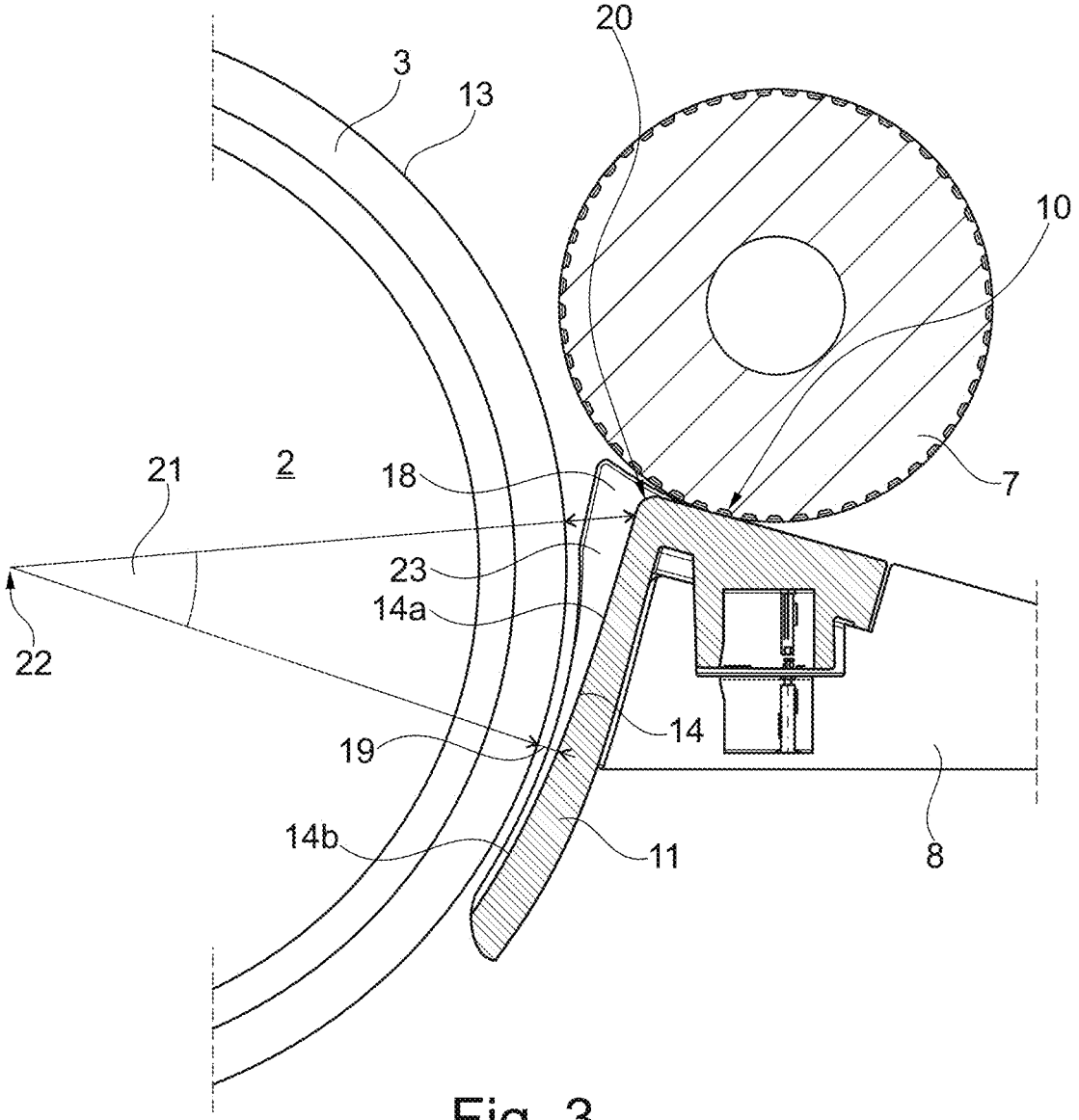
FIG. 3 is a detailed view of the fibre band opening device according to the present invention.

In FIG. 3, the feed tray 11 and its arrangement in relation to the fibre band pull-in cylinder 7 and to the opening roller 2 are shown in greater detail. In the embodiment example shown, the feed tray 11 is detachably connected to the feed tray holder 8, as is also disclosed in DE 10 2017 118 392 A1 for example. In the present invention, the feed tray 11 and the feed tray holder 8 can also be formed as a single piece, or the feed tray 11 can consist of several parts connected to one another by means of the feed tray holder 8.

The fibre band pull-in cylinder 7 transports the feed fibre band 4, in conjunction with the clamping surface 10 of the feed tray 11, towards the opening roller 2. Following the clamping surface 10 of the feed tray 11, the feed fibre band 4 runs through a transition area 20 of the feed tray 11 having a convex, i.e. outwardly curved, curvature. At the end of the transition area 20, i.e. after the end of the convex curvature, a support surface 14 for fixing the fibre tuft processed by the opening roller 2 begins. The comb-in point lies between the transition area 20 and the support surface 14. In the embodiment example shown, the support surface 14 comprises two partial surfaces 14*a* and 14*b*. The surface 14*a* that is first in the fibre transport direction is flat or plane. At the comb-in point, the surface 14*a* has a distance from the circular cylindrical surface 13 on which the tips 12 of the opening roller clothing 3 lie, which distance is given the reference sign 18. The distance is the perpendicular from the support surface 14 onto the circular cylindrical surface 13 on which the tips 12 of the opening roller clothing 3 lie. This distance is tapered in the fibre transport direction to a minimum distance. In the embodiment example shown, the distance of the flat partial surface 14*a* is tapered to the minimum distance 19. The following partial surface 14*b* is concave, i.e. inwardly curved. The surface 14*b* is likewise in the form of a circular cylindrical surface, the centre axis corresponding to the axis of rotation 22 of the opening roller 2. That means the distance of the surface 14*b* from the circular cylindrical surface 13 on which the tips 12 of the opening roller clothing 3 lie corresponds continuously to the minimum distance 19. According to the present invention, the distance 18 is between 4 and 8 millimetres and the distance 19 is less than 1.5 millimetres. In the embodiment example shown, the distance 19 is also greater than 0.6 millimetres.

The tapering of the distance of the support surface 14, or more precisely of the partial surface 14*a*, from the circular cylindrical surface 13 from the beginning of the support surface 14 to the minimum distance 19 extends over an angle range in the direction of rotation of the opening roller 2, which angle range is labelled with the reference sign 21. This angle range 21 is less than 30° in the embodiment example shown.

Figure 2:
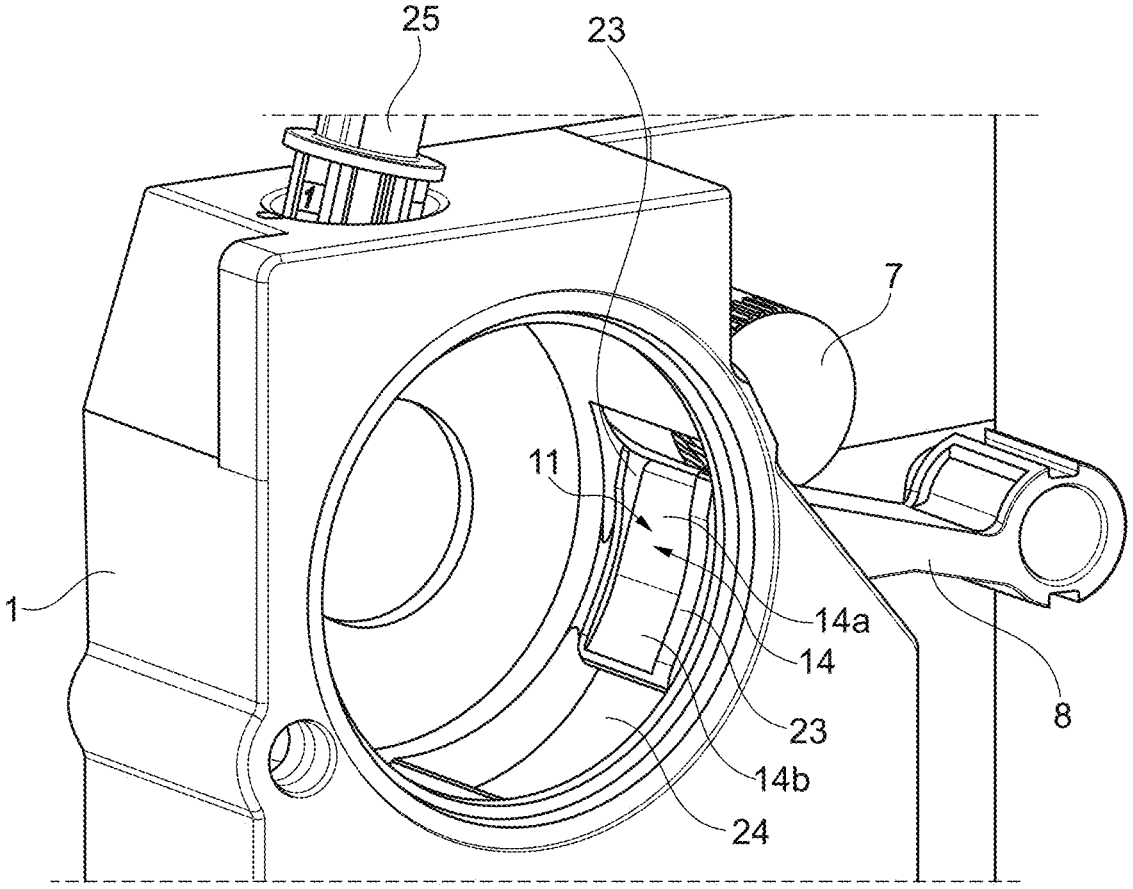
FIG. 2 is a three-dimensional illustration of an opening roller housing with a feed tray according to the present invention.

The feed tray 11 shown in FIG. 2 and in FIG. 3 also has, in the area of the support surface 14, lateral guide walls 23 for guiding the feed fibre band 4, which extend from the beginning to the end of the support surface 14, i.e. over both partial surfaces 14*a* and 14*b*.

LIST OF REFERENCE SIGNS

1 Opening roller housing
2 Opening roller
3 Opening roller clothing
4 Feed fibre band
5 Arrow
6 Arrow
7 Fibre band pull-in cylinder
8 Feed tray holder
9 Condenser
10 Clamping surface
11 Feed tray
12 Tips of the opening roller clothing
13 Circular cylindrical surface
14 Support surface
15 Arrow
16 Pivot axis
17 Arrow
18 Distance
19 Distance
20 Transition area
21 Angle
22 Axis of rotation of the opening roller
23 Lateral guide walls
24 Trash outlet opening
25 Fibre guide channel It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements.

What is claimed is:

1. A fibre band opening device for an open-end spinning device, comprising:

a feed tray, a fibre band pull-in cylinder and an opening roller having an opening roller clothing, wherein the opening roller clothing having tips and the tips of the opening roller clothing lie on a circular cylindrical surface, wherein the fibre band pull-in cylinder is designed to transport, in conjunction with a clamping surface of the feed tray, a feed fibre band towards the opening roller, the feed tray has a support surface for fixing a fibre tuft, which is processed by the opening roller by combing, and the support surface has a distance from the circular cylindrical surface and the distance is tapered in a fibre transport direction to a minimum distance, and the feed tray has a transition area having a convex curvature between the clamping surface and the support surface, characterised in that the support surface has a distance of between 4 and 8 millimetres from the circular cylindrical surface at a beginning of the support surface with respect to the fibre transport direction, and wherein the beginning of the support surface is a comb-in point for fibres, and that the minimum distance of the support surface from the circular cylindrical surface is greater than 0.6 millimetres and the minimum distance of the support surface from the circular cylindrical surface is less than 1.5 millimetres.

2. The fibre band opening device according to claim 1, characterised in that the tapering of the distance of the support surface from the circular cylindrical surface from the beginning of the support surface to the minimum distance extends over an angle range of less than 30° in a direction of rotation of the opening roller.

3. The fibre band opening device according to claim 1, characterised in that the support surface is designed as a flat surface from the beginning of the support surface until the minimum distance from the circular cylindrical surface is reached.

4. The fibre band opening device according to claim 1, characterised in that the support surface continues in the fibre transport direction at a constant distance from the circular cylindrical surface after the minimum distance has been reached.

5. The fibre band opening device according to claim 1, characterised in that the support surface comprises a concave surface.

6. The fibre band opening device according to claim 1, characterised in that the support surface comprises a flat surface, which transitions tangentially into a concave surface.

7. The fibre band opening device according to claim 1, characterised in that the feed tray has, in an area of the support surface, lateral guide walls for guiding the feed fibre band, which extend from the beginning to an end of the support surface.

8. A feed tray for a fibre band opening device according to claim 1, comprising:

the clamping surface, which is designed to transport, in conjunction with the fibre band pull-in cylinder, the feed fibre band towards the opening roller having the opening roller clothing, the tips of which lie on the circular cylindrical surface, the support surface for fixing the fibre tuft, which is processed by the opening roller by combing, the distance of the support surface from the circular cylindrical surface being tapered in the fibre transport direction to the minimum distance, and the transition area having the convex curvature between the clamping surface and the support surface, characterised in that the distance of the support surface from the circular cylindrical surface is between 4 and 8 millimetres at the beginning of the support surface with respect to the fibre transport direction and that the minimum distance of the support surface from the circular cylindrical surface is greater than 0.6 millimetres and minimum distance of the support surface from the circular cylindrical surface is less than 1.5 millimetres.

* * * * *